US009237981B1

(12) United States Patent
Clementes

(10) Patent No.: US 9,237,981 B1
(45) Date of Patent: Jan. 19, 2016

(54) MASSAGE DEVICE

(71) Applicant: Aileen Clementes, Surrey (CA)

(72) Inventor: Aileen Clementes, Surrey (CA)

( * ) Notice: Subject to any disclaimer, the term of this patent is extended or adjusted under 35 U.S.C. 154(b) by 665 days.

(21) Appl. No.: 13/647,501

(22) Filed: Oct. 9, 2012

Related U.S. Application Data

(63) Continuation-in-part of application No. 12/407,735, filed on Mar. 19, 2009, now Pat. No. 8,500,666.

(60) Provisional application No. 61/070,059, filed on Mar. 20, 2008.

(51) Int. Cl.
*A61H 7/00* (2006.01)

(52) U.S. Cl.
CPC . *A61H 7/003* (2013.01); *A61H 7/00* (2013.01)

(58) Field of Classification Search
CPC ..... A61H 7/00–7/003; A61H 7/007; A61H 2007/009; A61H 15/00; A61H 15/0092; A61H 2015/0007–2015/0071; A61H 39/02–39/04; A61H 2201/0157; A61H 2201/1604; A61H 2201/1635–2201/1638; A61H 2201/1676–2201/1678; A61H 2205/02–2205/021
See application file for complete search history.

(56) References Cited

U.S. PATENT DOCUMENTS

| | | | | |
|---|---|---|---|---|
| 1,710,643 | A | 4/1929 | Hassler | |
| 2,690,746 | A | 10/1954 | Achberger | |
| 2,959,167 | A | 11/1960 | Leclabart | |
| 4,744,350 | A | 5/1988 | Sato | |
| 4,798,194 | A | 1/1989 | Amishima | |
| 5,382,222 | A | 1/1995 | Yih-Jong | |
| 5,389,063 | A | 2/1995 | Wu | |
| 5,632,721 | A | 5/1997 | Kuan | |
| 5,725,483 | A | 3/1998 | Podolsky | |
| 5,843,005 | A | 12/1998 | Chubinsky | |
| 2006/0084894 | A1 | 4/2006 | Anderson | |
| 2009/0240176 | A1* | 9/2009 | Clementes | A61H 7/003 601/135 |
| 2011/0270013 | A1* | 11/2011 | Labash | A61H 39/04 600/15 |
| 2012/0143081 | A1 | 6/2012 | Lyu | |

* cited by examiner

*Primary Examiner* — Rachel Young
(74) *Attorney, Agent, or Firm* — P. Jeff Martin, Esq.; The Law Firm of P. Jeffrey Martin, LLC

(57) ABSTRACT

A therapeutic massage device, specifically a manual scalp massager that can both provide a soothing sensation to the user and also stimulate the sebaceous glands and hair follicles of a person's scalp, resulting in a healthier scalp and better looking hair. The device should efficiently, and without harm or discomfort to the user, be able to pinch the tightly drawn scalp of the user, thereby squeezing the sebaceous glands and improving oil production. The device should also be easy to use and should not require an inordinate amount of effort by the operator. In operation, the device can massage one's scalp by alternating between constricting and releasing the skin.

20 Claims, 4 Drawing Sheets

MASSAGE DEVICE

RELATED APPLICATIONS

The present application is a Continuation-in-Part of application Ser. No. 12/407,735, filed on Mar. 19, 2009, which claims the benefit of U.S. Provisional Application No. 61/070,059 filed on Mar. 20, 2008.

TECHNICAL FIELD OF THE INVENTION

The present invention relates generally to therapeutic massage devices, and more particularly, to a handheld device for massaging a person's head.

BACKGROUND OF THE INVENTION

The art of massage has been used to relieve stress and physical ailments for thousands of years. Although massage often focuses on the muscles and tendons of a person's back and neck, just about every part of the human body can benefit from some form of massage. In particular, regular physical stimulation of the head and scalp can provide not only psychological therapy, but also increased productivity of sebaceous glands and hair follicles, resulting in a healthier scalp and improved hair quality and appearance. However, it can be tiresome and difficult to massage one's own scalp, especially for people who have arthritis or other conditions that prevent prolonged use of the hands. Moreover, excess oils and dirt can be transferred from a person's hands to their own scalp or that of another person. In addition, since the skin on a person's head is tightly drawn, in contrast with most other parts of the body, it can be difficult to stimulate and squeeze the sebaceous glands with conventional massage methods and devices.

Currently, there are several products on the market intended to eliminate the need for direct hand-to-scalp contact when performing massage. However, these devices only glide over the scalp or apply light pressure at certain points, and are thus useful only when a calming effect is desired. For example, the Head Trip Therapeutic Massager from The Happy Company has multiple long metal prongs, the tips of which a user places on her head and lowers and raises to rub against the scalp. While this device may provide an enjoyable sensation for some, it can also be bothersome or inadequate for people looking for more of a rubbing and/or pinching massage. This type of device can also be difficult to use; since its handle is a great distance away from the prong tips, a user must reach high above her head in order to operate the device. Moreover, the prong tips have very little surface area, resulting in little contact with the scalp and inadequate stimulation of the sebaceous glands and/or hair follicles.

What is needed is a hand-held device that can be used on one's own scalp or that of another person, which can both provide mental relaxation and promote healthy oil production from the sebaceous glands of one's scalp through gentle squeezing of the skin. The device should be designed to gently tug at or pinch the tightly drawn skin on a person's head without causing pain or discomfort. The device should also be easy to use and clean, lightweight, and portable.

SUMMARY OF THE INVENTION

A hand-held massage device can comprise two frame elements. Each frame element can comprise a pivotal link member, a support member coupled with the distal end of the pivotal link member, and a set of a plurality of massage members coupled with the support member. Frame elements can be pivotally coupled, such that when the proximal ends of the pivotal link members have a first distance between them, the support members have a second distance between them; and when the proximal ends of the pivotal link members have a third distance between them that is greater than the first distance, the support members have a fourth distance between them that is less than the second distance. In some embodiments, a frame element can further comprise a handle member.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

It will be readily understood that the components of the present invention, as generally described and illustrated in the figures herein, may be arranged and designed in a wide variety of different configurations. Thus, the following detailed description of the embodiments of a massage device, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
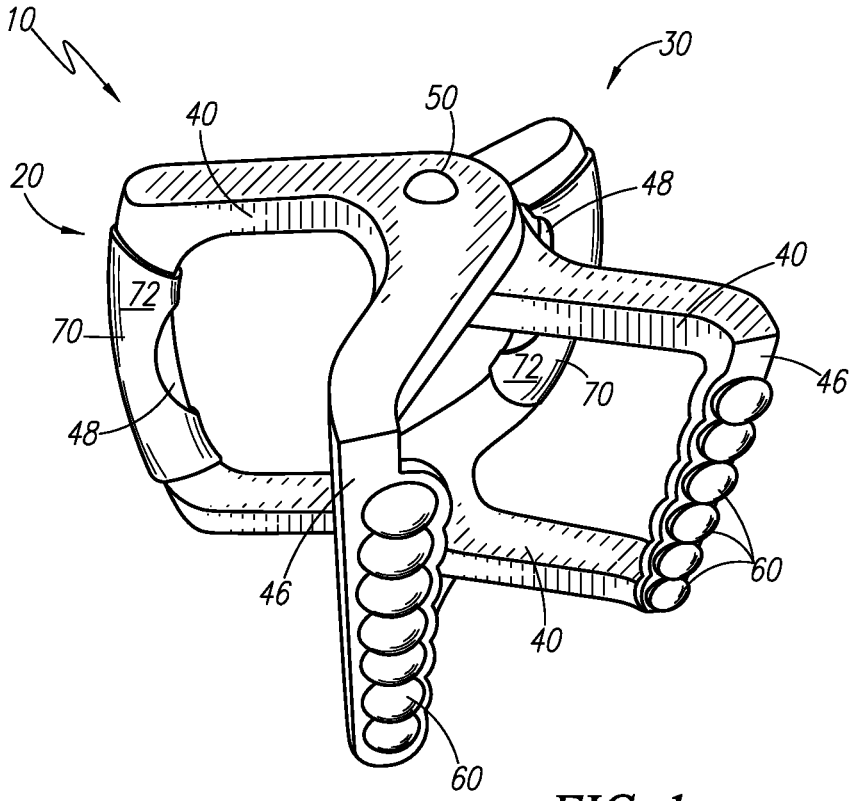
FIG. 1 depicts an isometric view of one embodiment of the present device.
Figure 1A:
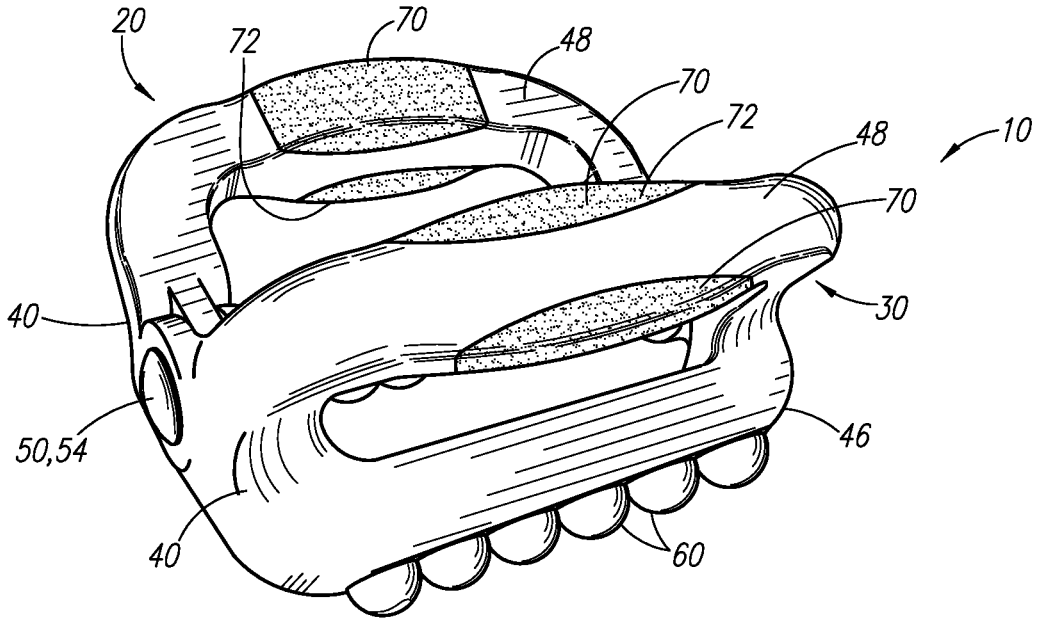
FIG. 1A is a top perspective view of the present device, in accordance to one embodiment thereof.
Figure 2:
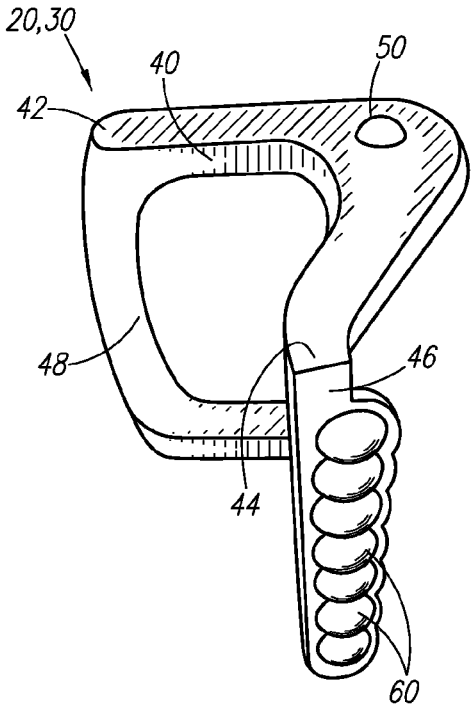
FIG. 2 depicts an isometric view of a frame element of the present device.

FIG. 1 illustrates an isometric view of the present device 10 according to one embodiment of the present invention, and FIG. 1A illustrates a top perspective view of the device in accordance to another embodiment of the present invention. The device 10 may comprise at least two frame elements 20 and 30 that can be pivotally coupled via a hinge mechanism 50. As shown in FIG. 2, each frame element 20, 30 can comprise a pivotal link member 40 that can have a proximal end 42 and a distal end 44. The distal end 44 of a pivotal link member 40 can be coupled with a support member 46, which in turn can be coupled with a set of a plurality of massage members 60. In some embodiments and as shown in FIGS. 1, 1A, and 2, the proximal end 42 of a pivotal link member 40 can also be coupled with a handle member 48. A pivotal link member 40 can be constructed of plastic, wood, polymer, metal, or any other known and/or convenient material or combination of materials. The type of material used to form a pivotal link member 40 can be determined based on desired properties, such as preventing hair from damage when the device 10 is in use. A pivotal link member 40 can also have a smooth surface, bumps or protrusions, grooves or indentations, or any other known and/or convenient surface characteristic. By way of non-limiting example, a portion of a pivotal link member can have a rough texture so as to increase the friction between the surface and a user's hand, thus preventing slippage. The surface of a pivotal link member 40 can also have a coating that can prevent slippage, provide anti-bacterial properties, condition a user's hair, or serve any other known and/or convenient purpose. A pivotal link member 40 can be any known and/or convenient color or combination of colors. As shown in FIG. 2, a pivotal link member 40 may comprise an A-shaped or generally arcuate configuration having both planar and curved surfaces. In alternate embodiments, a pivotal link member 40 can have any other known and/or convenient geometry. A pivotal link member 40 can be formed by injection molding or any other known and/or convenient method of manufacturing.

A support member 46 can provide support for and be coupled with a set of a plurality of massage members 60. A support member 46 can be constructed of plastic, wood, silicone, rubber, metal, ceramic, glass or any other known and/or convenient material. The material used to form a support member can be rigid or semi-rigid. A support member 46 can be constructed of the same material as a pivotal link member 40 and/or a plurality of massage members 60, or can be comprised of a material different from other components of a device 10. The type of material used to form a support member 46 can be determined based on desired properties, such as preventing damage to hair while in use. The surface of a support member 46 can be smooth, rough, or have any other known and/or convenient surface characteristic. By way of non-limiting example, a support member 46 can be constructed of polystyrene and can have a smooth surface so as to allow hair to glide along the surface without catching and without being damaged. The surface of a support member 46 can also have antibacterial or conditioning properties, or any other known and/or convenient properties. A support member 46 can be any known and/or convenient color or combination of colors, and can be the same as or different than the color of other components of a device 10.

Figure 4:
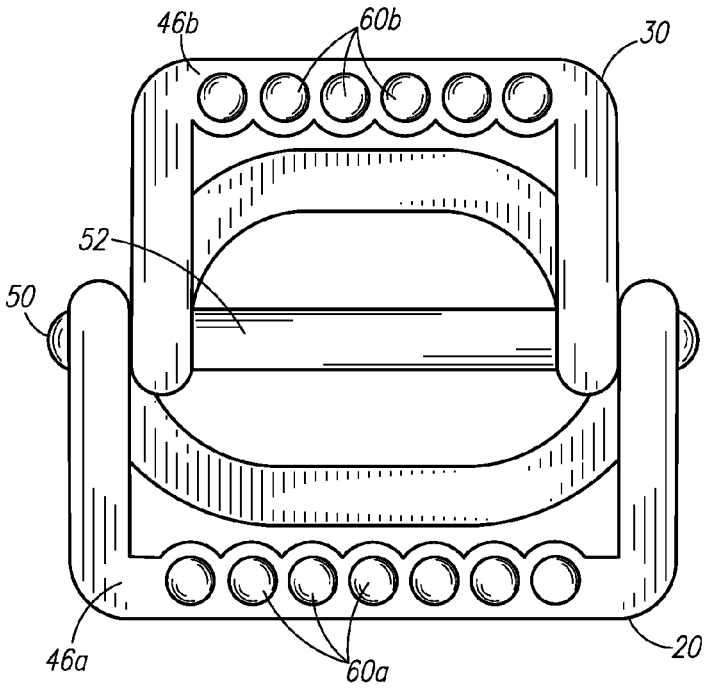
FIG. 4 depicts an underside view of one embodiment of the present device.
Figure 5:
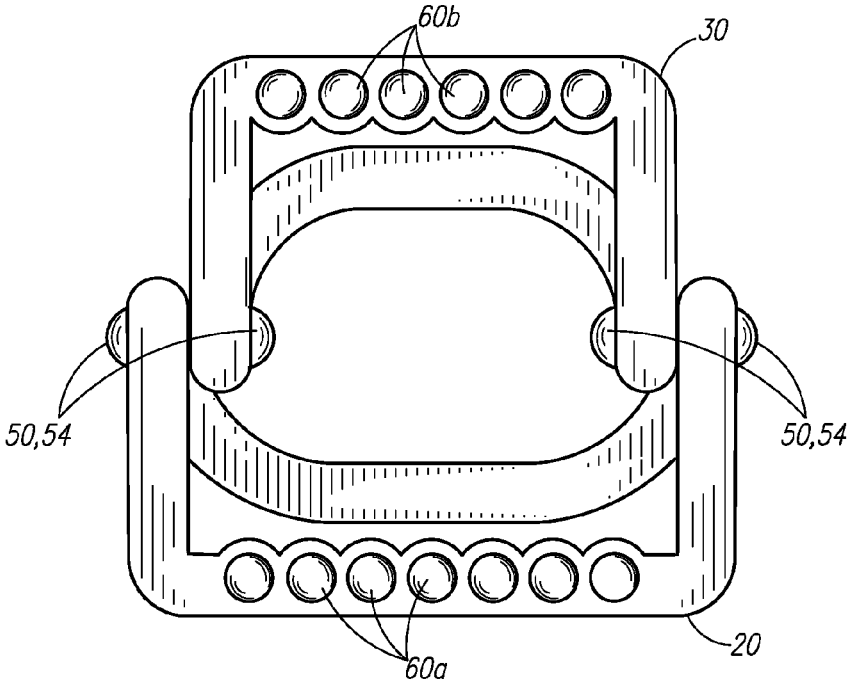
FIG. 5 depicts an underside view of another embodiment of the present device.

FIGS. 1, 1A, and 2 depict a plurality of massage members 60. A set of massage members 60 can be coupled with a support member 46 of a frame element 20, 30. A plurality of massage members 60 can be coupled with a support member 46 via adhesive, ultrasonic bonding, pins, nails, or any other known and/or convenient method of bonding. As shown in FIG. 4, a first set of massage members 60*a* coupled with a first support member 46*a* of first frame element 20 can have a different number of massage members 60 than a second set of massage members 60*b* coupled with a second support member 46*b* of second frame element 30. In other embodiments, each set of massage members 60 on two or more frame elements 20 and 20 can have the same number of massage members 60. As depicted in FIGS. 4 and 5, a first set of massage members 60*a* of first frame element 20 may comprise seven (7) massage members 60*a*, and a second set of massage members 60*b* of second frame element 30 may comprise six (6) massage members 60*b*. Each set of massage members 60 can be positioned such that when their respective support members 46 are brought together, each massage member 60 on a first support member 46 can be staggered with respect to each massage member 60 on a second support member 46.

Figure 6A:
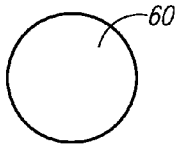
FIGS. 6A-6D depict several embodiments of a massage member of the present device.

In some embodiments, a plurality of massage members 60 can comprise polymer, wood, metal, ceramic or any other known and/or convenient rigid material or combination of rigid materials that will not deform upon the application of pressure in normal use of the device 10. In alternate embodiments, a plurality of massage members 60 coupled with a support member 46 can comprise flexible or semi-flexible material so as to deform to a desired degree when pressed against a user's scalp 100, as depicted in FIG. 6D. A flexible or semi-flexible massage member can be constructed entirely of one material, such as silicone. In other embodiments, a flexible material, such as but not limited to microfiber, velvet, nylon, silk, or natural fabric, can encapsulate another flexible material or combination of materials, such as but not limited to gel, small beads, or silicone. By way of non-limiting example, as shown in FIG. 6C, a massage member 60 can comprise a plurality of small rigid beads 64 partially bounded by Neoprene.

Figure 6B:
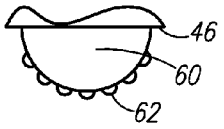
Figure 6C:
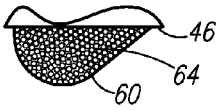
Figure 6D:
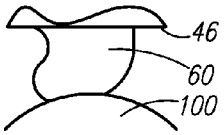

As illustrated in FIG. 6B, the surface of a massage member 60 may comprise small protrusions 62 that can provide a different type of sensation and/or sebaceous gland stimulation as compared with a smooth or rough surface. In other embodiments, the surface of a massage member 60 can have ridges or any other known and/or convenient surface characteristic. The coefficients of friction of the surfaces of massage members 60 are determined by the surface material, which in turn can affect how massage members 60 can glide against a person's scalp 100. By way of non-limiting example, a rough rubber surface on a massage member 60 can slightly tug at the scalp 100 when a device 10 is in use, while a smooth plastic surface can easily slide over the scalp 100 and hair (not shown).

A massage member 60 can also have anti-bacterial or conditioning properties, either embedded or as a coating, or can have any other known and/or convenient properties. Massage members 60 can be any known and/or convenient color or combination of colors, and at least one massage member 60 can be a different color than another massage member 60.

Figure 3:
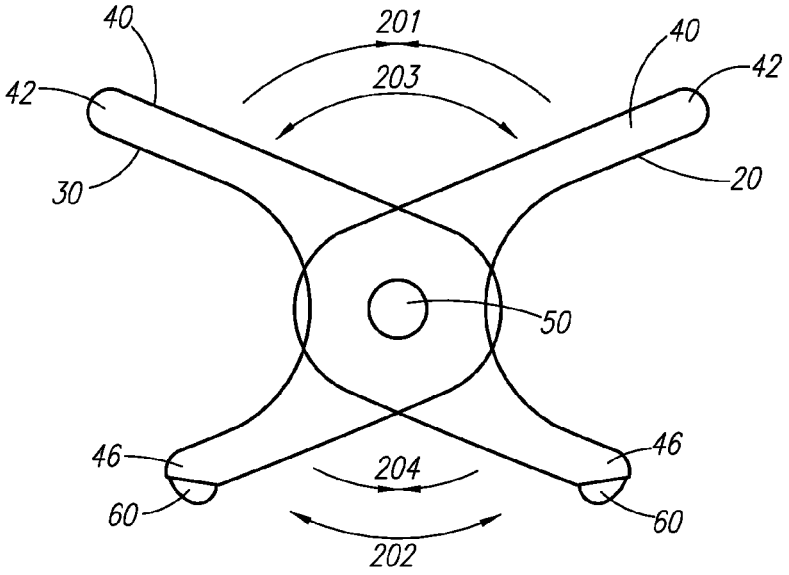
FIG. 3 depicts a side view of the embodiment depicted in FIG. 1.

A plurality of massage members 60 can be spherical, elliptical, or can have any known and/or convenient geometry. The geometry of massage members 60 can affect the massaging effect that is produced by use of the device 10. As shown in FIG. 3, massage members 60 can have a teardrop-like geometry such that in use a large portion of the surface area of a massage member 60 can be in constant contact with a user's scalp and/or hair. Moreover, a teardrop geometry, as shown in FIG. 3, can provide a tugging or pinching effect on the scalp, thereby imparting a different sensation and/or gland stimulating effect when compared with a massage member 60 having less surface area contact with a user's scalp. As shown in FIG. 6A, in one embodiment a cross-section of a massage member 60 can be circular. In other embodiments, a massage member 60 can have any other known and/or convenient cross-section. Although FIG. 1 depicts a plurality of massage members 60 having the same geometry, in other embodiments at least one massage member 60 can have a different geometry than another massage member 60.

As shown in FIGS. 1, 1A, and 2, frame elements 20 and 30 each further comprise a handle member 48 coupled with the proximal end 42 of a pivotal link member 40. A handle member 48 can be constructed of wood, polymer, metal, or any other known and/or convenient rigid or semi-rigid material suitable for accommodating a user's grip. A pivotal link member 40 and a handle member 48 can be comprised on the same material or combination of materials. In other embodiments, the materials can be different. A handle member 48 can have a circular, square, or elliptical latitudinal cross-section, or can have any other known and/or convenient cross-section geometry. A handle member 48 can be formed from the same piece of material as a pivotal link member 40, as shown in FIGS. 1, 1A, and 2. In other embodiments, a handle member 48 can be manufactured as a separate element that is subsequently bonded with a pivotal link member 40 via adhesive, ultrasonic bonding, nails, screws, or any other known and/or convenient method of bonding. A handle member 48 can also have antibacterial properties and/or can be coated with a material that can prevent hand slippage when in use.

In reference to FIGS. 1 and 1A, and in accordance to one embodiment of the present invention, handle member 48 may be covered or partially covered with a pliable gel sleeve 70. The gel sleeve 70 is preferably encased by a resilient outer surface 72. The gel sleeve 70 may be filled with a silicon-based gel, thus being readily moldable.

A pivotal link member 40, handle member 48, support member 46, and massage members 60 can be formed from a single piece of material. In other embodiments, the aforementioned elements can be formed as separate parts and subsequently permanently or temporarily bonded via adhesive, ultrasonic bonding, nails, screws, staples, pins, or any other known and/or convenient method of bonding. Each frame element 20, 30 and/or elements thereof can be made by injection molding or any other known and/or convenient method of manufacturing.

As depicted in FIGS. 1-5, frame elements 20 and 30 can be pivotally coupled at any convenient point on each pivotal link member 40 via a hinge mechanism 50. As shown in FIGS. 1 and 1A, the pivot points of frame elements 20 and 30 can be proximate to the vertex of an angled segment of each pivotal link member 40. In FIG. 4, a hinge mechanism 50 is a rod 52 extending through each pivot point of framing elements 20 and 30. In an alternate embodiment, and as shown in FIG. 5, a hinge mechanism 50 can comprise pins 54 that extend only through the portions of the pivot points of framing elements 20 and 30 that are in direct contact with each other. In yet alternate embodiments, a hinge mechanism 50 can be any other known and/or convenient mechanism that can pivotally couple at least two framing elements 20 and 30.

Referring to FIG. 3, frame elements 20 and 30 can be pivotally coupled with each other such that when the proximal ends 42 of pivotal link members 40 have a first distance 201 between them, support members 46 can have a second distance 202 between them; and when the proximal ends 42 of pivotal link members 40 have a third distance 203 between them that is greater than a first distance 201, support members 46 can have a fourth distance 204 between them that is less than a second distance 202.

Figure 7:
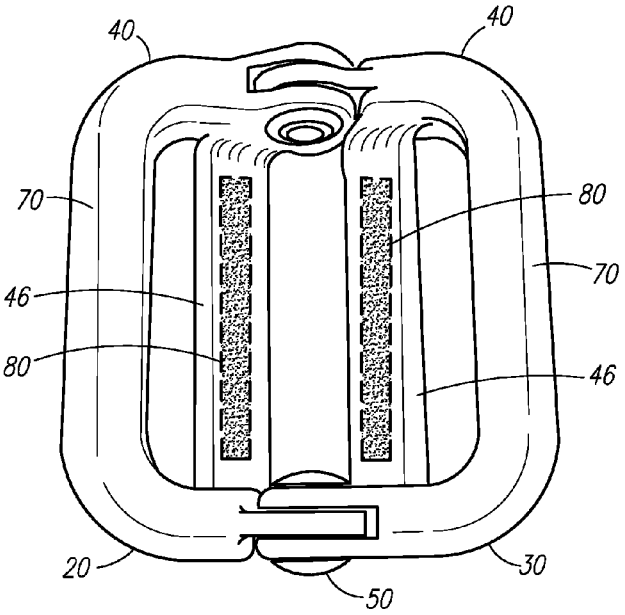
FIG. 7 is a top plan view of one embodiment of the present invention illustrating a pivot restraining means.
Figure 8:
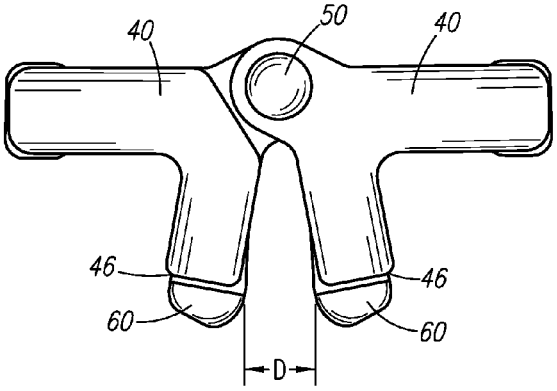
FIG. 8 is a side elevational view of the device of FIG. 7 illustrating a repulsion distance or zone.

Referring now to FIGS. 7-8, in accordance to one embodiment of the present invention, the device 10 comprises means for preventing pivotal movement by support members 46 about a repulsion distance. More specifically, the support member 46 of each frame element 20, 30 is axially disposed with a magnet 80, the magnet 80 preferably being an elongated, permanent magnet. The magnet 80 is encapsulated by support member 46. Magnets 80 are disposed in respective support members and oriented therein such that support members 46 freely pivot in a converging manner until reaching a repulsion distance, the repulsion distance indicated by dimension D. The magnets 80 are oriented inside respective support members 46, and comprise (magnetic properties) which cause support members to undergo a repulsion force (repel one another) upon reaching the repulsion distance D, thereby providing the device with an automatic stop against pivotally-converged movement by support members 46 within the repulsion distance D or zone. Repulsion distance D is a distance ranging from about 0.20 inches to 3.25 inches, preferably from about 0.25 inches to inches 1.75 inches, and most preferably from about 0.35 inches to 0.65 inches.

In accordance to an alternate embodiment, each frame element 20, 30 may be axially disposed with a series of short magnets 80 linearly aligned, the short magnets 80 conjunctively providing a linearly elongated magnetic member. The series of short magnets 80 may also be collectively joined to form the linearly elongated magnetic member.

The magnet 80 may comprise a wide variety of permanent magnets including rare earth magnets, alnico magnets, ceramic magnets, and flexible magnets. Other suitable magnets for use as described hereinabove may include rare earth magnets such as Samarium Cobalt and neodymium iron classes.

Ceramic or Ferrite magnets are made of a composite of iron oxide and barium or strontium carbonate. These materials are readily available and at a lower cost than other types of materials used in permanent magnets making it desirable due to the lower cost. Ceramic magnets are produced using pressing and sintering, but are brittle and require diamond wheels if grinding is necessary. These magnets are made in different grades. Ceramic grade 1 is an isotropic grade having equal magnetic properties in all directions. Ceramic grades 5 and 8 are anisotropic grades. Anisotropic magnets are magnetized in the direction of pressing. The anisotropic method delivers the highest energy product among ceramic magnets at values up to 3.5 MGOe (Mega Gauss Oersted). Ceramic magnets possess a good balance of magnetic strength, resistance to demagnetization and low cost.

Flexible magnets are magnets made of flexible materials that are bonded with a magnetic material. Flexible magnets are advantageous in that they may be bent, coiled, twisted, or otherwise machined into almost any desired shape without depleting their magnetic field. Flexible magnets are corrosion resistant, do not need a coating, are easily machined, and may be bonded with a high magnetic energy material.

Rare earth metal magnets are composed of more expensive magnetic material. Rare earth magnets may be coated onto a flexible material, e.g., plastic or nylon, and will provide excellent magnetic strength and flexibility. These magnets can also be manufactured so as to be very thin.

Alnico magnets are made primarily from a composite of aluminum, nickel, and cobalt with small amounts of other elements added to enhance the properties of the magnet. Alnico magnets possess excellent temperature stability, good resistance to demagnetization due to shock, but are easily demagnetized. Alnico magnets are produced by two typical methods, namely, casting or sintering. Sintering offers superior mechanical characteristics, whereas casting delivers higher energy products (up to 5.5 MGOe) and allows for the design of intricate shapes. Alnico magnets are made in different grades. Grades 5 and 8, which are anisotropic grades, are two very common grades. Anisotropic grades provide for a preferred direction of magnetic orientation. Alnico magnets have been replaced in many applications by ceramic and rare earth magnets.

In use, the operator of a device 10 can be either the person whose scalp is to be massaged or another person. The operator of a device 10, as depicted in FIG. 1, can grip handle members 48 of framing elements 20 and 30. Massage members 60 can then be placed in contact with the scalp of either the operator or another person. The proximal ends 42 of pivotal link members 40 can begin with a close distance 201 between them, and support members 46 can begin with an extended distance 202 between them. The proximal ends 42 of pivotal link members 40 can then be separated to a distance 203 between them by pivoting frame elements 20 and 30 via the hinge mechanism 50. This action can cause support members 46 to move closer together to a distance 204 between them, gently squeezing the scalp. An operator can then repeat the aforementioned actions at any desired speed and while applying a desired amount of pressure on the device 10. These actions can cause massage members 60 to move about a person's scalp, alternating between squeezing and releasing the skin, resulting in a calming sensation. Additionally, the teardrop geometry of massage members 60, as shown in FIG. 3, can allow a large surface area of massage members 60 to be in constant contact with a person's scalp, thereby facilitating a tugging or pinching effect.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims when considered with a full range of equivalents, and modifications thereto.

What is claimed is:

1. A massage device, comprising:

a first frame element comprising a first pivotal link member, a first support member coupled with a distal end of the first pivotal link member, and a first set of a plurality of massage members coupled with the first support member;

a second frame element comprising a second pivotal link member, a second support member coupled with a distal end of the second pivotal link member, and a second set of a plurality of massage members coupled with the second support member; wherein the first frame element and the second frame element are pivotally coupled along one pivot axis via at least one hinge mechanism; and means for preventing pivotal movement by the first support member and the second support member about a repulsion distance.

2. The massage device of claim 1, wherein the first frame element further comprises a first handle member, and the second frame element further comprises a second handle member.

3. The massage device of claim 1, wherein at least one of the first and second pivotal link members has a non-slip gripping portion.

4. The massage device of claim 1, wherein at least one of the first and second sets of a plurality of massage members is constructed of a material selected from the group consisting of plastic, wood, silicone, rubber, metal, ceramic, and glass.

5. The massage device of claim 1, wherein the first set of a plurality of massage members comprises a different number of massage members than the second set of a plurality of massage members.

6. The massage device of claim 1, wherein at least one member of at least one of the first and second sets of a plurality of massage members is adapted to partially deform when pressed against a person's scalp.

7. The massage device of claim 1, wherein at least one member of at least one of the first and second sets of a plurality of massage members has an elliptical cross-section.

8. The massage device of claim 1, wherein the at least one hinge mechanism comprises a pin that extends through the pivot points of the first and second pivotal link members.

9. The massage device of claim 1, wherein the first and second pivotal link members each comprise one or more angled segments and the pivot points are positioned proximate to the vertex of an angle formed by the angled segments.

10. The massage device of claim 1, wherein the means for preventing pivotal movement by the first support member and the second support member comprises a first magnet and a second magnet, the first magnet is axially encapsulated by the first support member, and the second magnet is axially encapsulated by the second support member.

11. The massage device of claim 10, wherein the first and second magnets are elongated and defined as permanent magnets.

12. The massage device of claim 11, wherein the first magnet and the second magnet are disposed in the first support member and the second support member and oriented therein, respectively, such that the first support member and the second support member freely pivot in a converging manner until reaching a repulsion distance.

13. The massage device of claim 12, wherein the repulsion distance is a distance ranging from about 0.20 inches to 3.25 inches.

14. The massage device of claim 12, wherein the repulsion distance measures approximately 0.50 inches.

15. The massage device of claim 1, wherein the first frame element further comprises a third pivotal link member, the second frame element further comprises a fourth pivotal link member, a first end of the first support member is coupled with the distal end of the first pivotal link member and a second end of the first support member is coupled with the distal end of the third pivotal link member, a first end of the second support member is coupled with the distal end of the second pivotal link member and a second end of the second support member is coupled with the distal end of the fourth pivotal link member, the third pivotal link member and the fourth pivotal link member are directly pivotally coupled along the pivot axis via at least one hinge mechanism at pivot points located substantially at the midpoints of the third pivotal link member and the fourth pivotal link member.

16. The massage device of claim 15, further comprising:

a first handle member coupled with the proximal ends of the first pivotal link member and the third pivotal link member; and a second handle member coupled with the proximal ends of the second pivotal link member and the fourth pivotal link member.

17. The massage device of claim 16, wherein the first handle member and the second handle member are each covered or partially covered with a pliable gel sleeve.

18. The massage device of claim 17, wherein the gel sleeve is encased by a resilient outer surface.

19. The massage device of claim 18, wherein the gel sleeve is filled with a silicon-based gel.

20. The massage device of claim 1, wherein the means for preventing pivotal movement by the first support member and the second support member comprises two or more magnets axially encapsulated by each the first support member and the second support member, respectively.

* * * * *